US009240651B2

(12) United States Patent
Thiel

(10) Patent No.: US 9,240,651 B2
(45) Date of Patent: Jan. 19, 2016

(54) UNIVERSAL DC POWER ADAPTOR

(71) Applicant: Laura Thiel, Raleigh, NC (US)

(72) Inventor: Laura Thiel, Raleigh, NC (US)

(73) Assignee: LAT Enterprises, Inc., Raleigh, NC (US)

( * ) Notice: Subject to any disclaimer, the term of this patent is extended or adjusted under 35 U.S.C. 154(b) by 60 days.

(21) Appl. No.: 14/166,013

(22) Filed: Jan. 28, 2014

(65) Prior Publication Data

US 2015/0214659 A1 Jul. 30, 2015

(51) Int. Cl.
*H01R 13/62* (2006.01)
*H01R 13/629* (2006.01)
*H01R 31/06* (2006.01)

(52) U.S. Cl.
CPC ..... *H01R 13/62977* (2013.01); *H01R 31/065* (2013.01)

(58) Field of Classification Search
CPC ..... H01R 13/24
USPC ..... 439/627, 338, 333, 334, 332, 341; 320/115, 113
See application file for complete search history.

(56) References Cited

U.S. PATENT DOCUMENTS 3,825,999 A * 7/1974 Rubey ..... 29/837
4,714,439 A * 12/1987 Marabotto et al. ..... 439/627
8,232,769 B2 * 7/2012 Paczkowski ..... 320/131

* cited by examiner

*Primary Examiner* — Abdullah Riyami
*Assistant Examiner* — Nelson R Burgos-Guntin
(74) *Attorney, Agent, or Firm* — Ward and Smith, P.A.; Jeffrey W. Childers

(57) ABSTRACT

A universal DC power adaptor for a PRC-148 radio, a PRC-152 radio, and a Handheld ISR Transceiver, and a method of using same, is disclosed. The presently disclosed universal DC power adaptor includes mounting and locking features that are common to both the PRC-148 radio and the PRC-152 radio. The universal DC power adaptor further includes certain mounting and locking features that are unique to the PRC-148 radio and other mounting and locking features that are unique to the PRC-152 radio. The universal DC power adaptor also provides an output voltage suitable for both the PRC-148 and PRC-152 radios. Such features also are compatible with the Handheld ISR Transceiver, making the universal DC power adaptor compatible with the ISR Transceiver as well. Additionally, the universal DC power adaptor includes programmable control electronics.

31 Claims, 19 Drawing Sheets

UNIVERSAL DC POWER ADAPTOR

TECHNICAL FIELD

The presently disclosed subject matter relates generally to DC power adaptors and, more particularly, to a universal DC power adaptor for a Handheld Intelligence, Surveillance, and Reconnaissance (ISR) Transceiver, a PRC-148 radio, and a PRC-152 radio, and a method of using same.

BACKGROUND

The military uses various types of portable battery-operated radios and handheld digital devices for reconnaissance. The handheld ISR Transceiver, such as those manufactured by, for example, L3 Communications, Raytheon Company, Harris Corporation, and Coastal Defense, Inc., is one example of such handheld digital devices. The PRC-148 radio and the PRC-152 radio are examples of military-spec portable battery-operated radios. The battery for the PRC-148 has certain unique features for mounting and locking the base of the radio to the battery. The battery for the PRC-152 has certain other unique features for mounting and locking the base of the radio to the battery. The battery for the Handheld ISR Transceiver has certain other unique features for mounting and locking the base of the device to the battery. There may be circumstances in which it may be beneficial to replace the battery of either type of radio, or the Handheld ISR Transceiver, with a DC power adaptor. In this case, the PRC-148 radio would require a DC power adaptor having a first set of features and providing a certain output voltage. Similarly, the PRC-152 radio would require a DC power adaptor having a second set of features and providing a different output voltage. Further still, the Handheld ISR Transceiver would require a DC power adaptor having a third set of features and providing a different output voltage. Consequently, because all three types of devices exist in the field, military personnel could be required to carry three types of DC power adaptors.

SUMMARY

In some aspects, the presently disclosed subject matter provides a universal DC power adaptor for coupling one of a Handheld ISR Transceiver, a PRC-148 radio, or a PRC-152 radio to a single external DC power source. The power adapter may include an adapter housing and an adapter plate assembly mounted to the adapter housing, wherein the adapter plate assembly further includes an adapter plate, a pair of locking plates, certain alignment features, a printed circuit board, and an input connector electrically coupled to the printed circuit board. The printed circuit board may further include control electronics and output voltage pins. Further, the pair of locking plates and certain alignment features are affixed to the top surface of the adaptor plate and configured to substantially align with corresponding features of the Handheld ISR Transceiver, PRC-148 radio, and PRC-152 radio such that any of the devices may twist and lock into the adaptor plate assembly, thereby mechanically coupling the device to the power adaptor and electrically coupling the device to the output voltage pins. The input connector may be configured to couple to any number of external power sources, including non-rechargeable batteries, rechargeable batteries, or other type of DC power source.

In certain other aspects, the power adaptor may include certain one or more side locking features and/or one or more holes or detents, wherein locking features unique to the Handheld ISR Transceiver, PRC-148 radio, or PRC-152 radio may engage with the power adapter to facilitate mechanical coupling.

In certain other aspects, the power adaptor's control electronics may include a controller and a power conditioner. The power conditioner may be configured to receive a certain input voltage and output a second voltage falling within a range acceptable to each of the Handheld ISR Transceiver, PRC-148 radio, and PRC-152 radio. The control electronics may further include a wired input/output port or a wired or wireless communications interface configured to facilitate programming of the controller and/or power conditioner.

Certain aspects of the presently disclosed subject matter having been stated hereinabove, which are addressed in whole or in part by the presently disclosed subject matter, other aspects will become evident as the description proceeds when taken in connection with the accompanying Examples and Drawings as best described herein below.

BRIEF DESCRIPTION OF THE DRAWINGS

Figure 1:
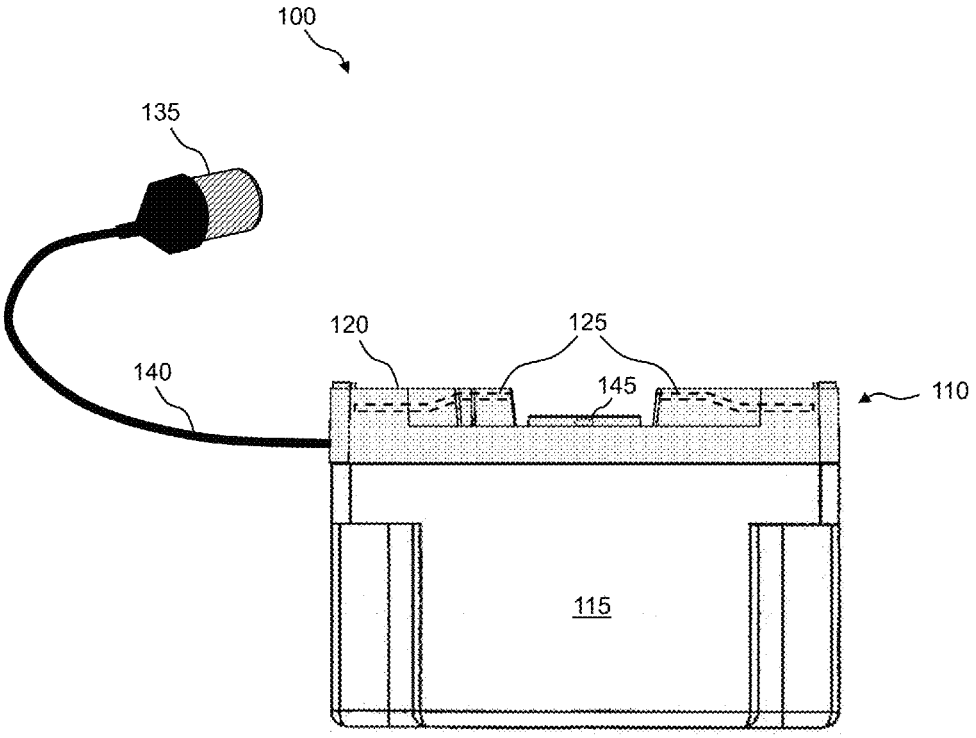
Figure 2:
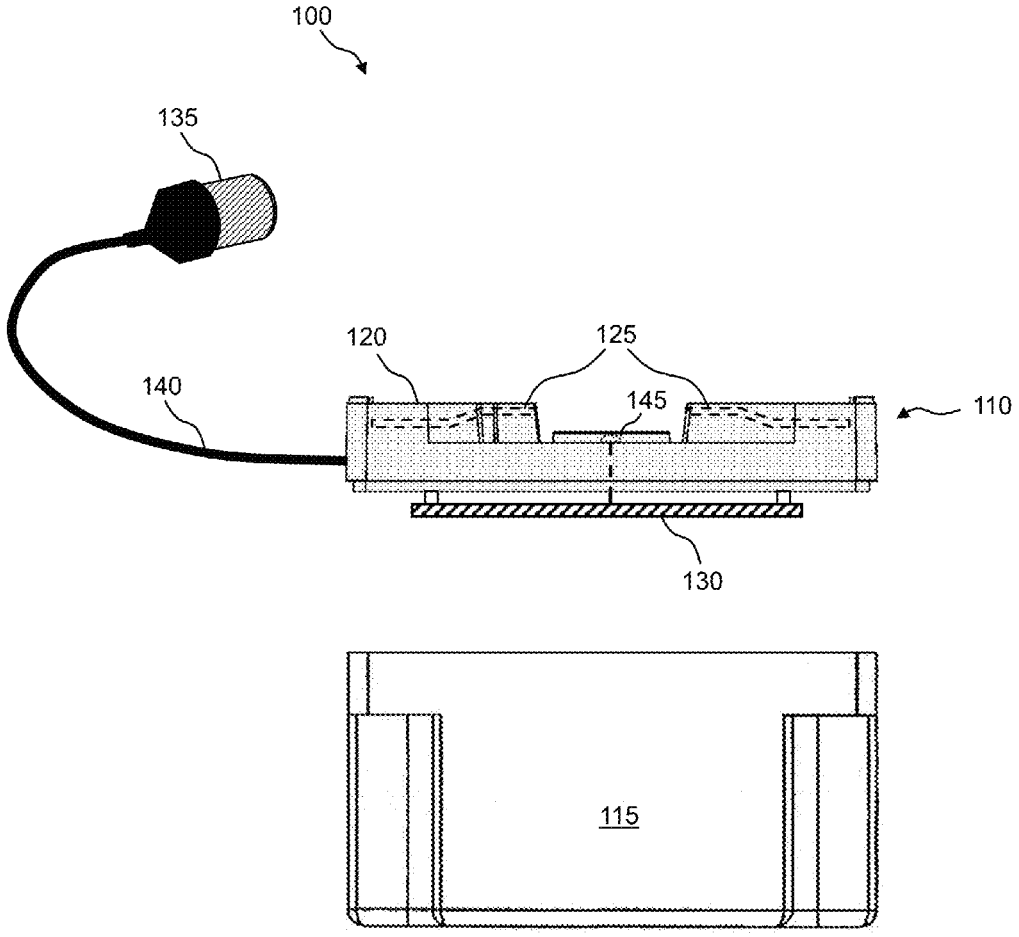
Figure 3:
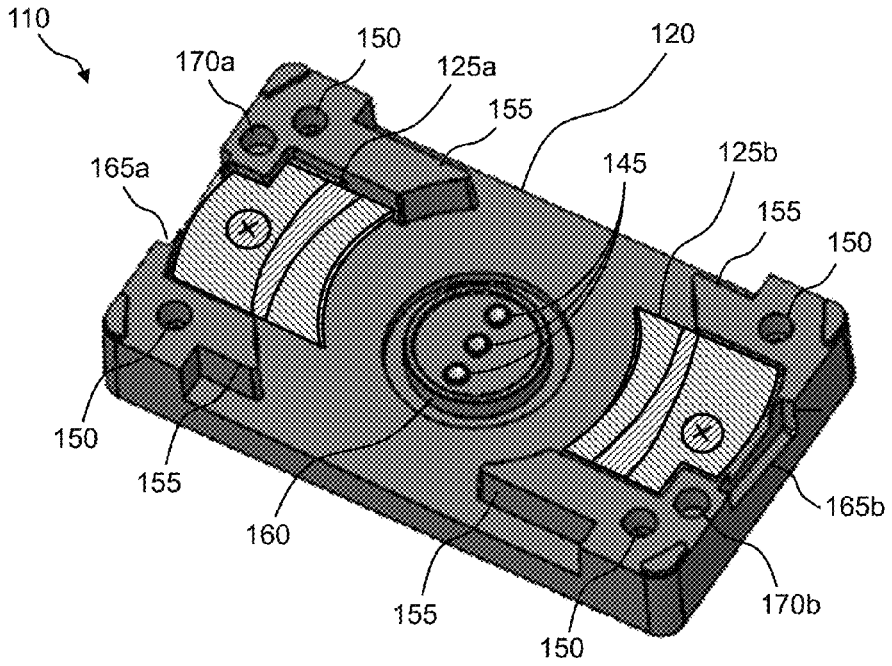
Figure 4:
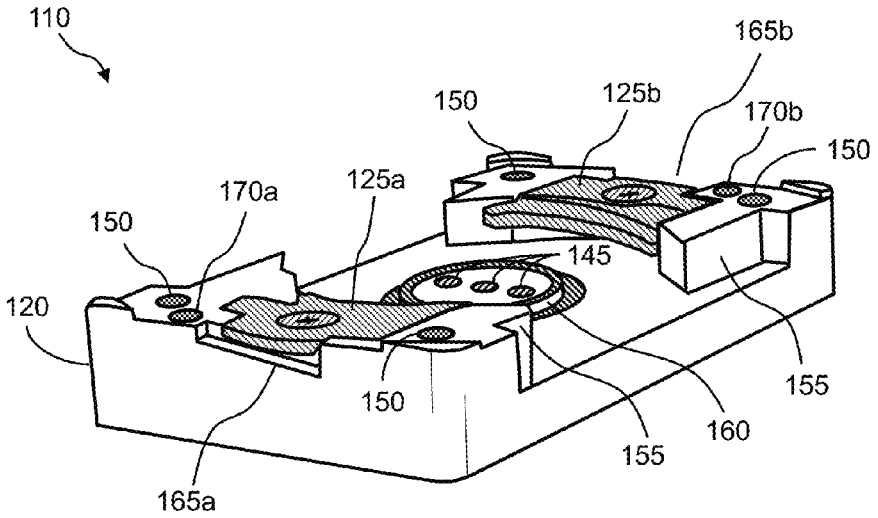
Figure 5:
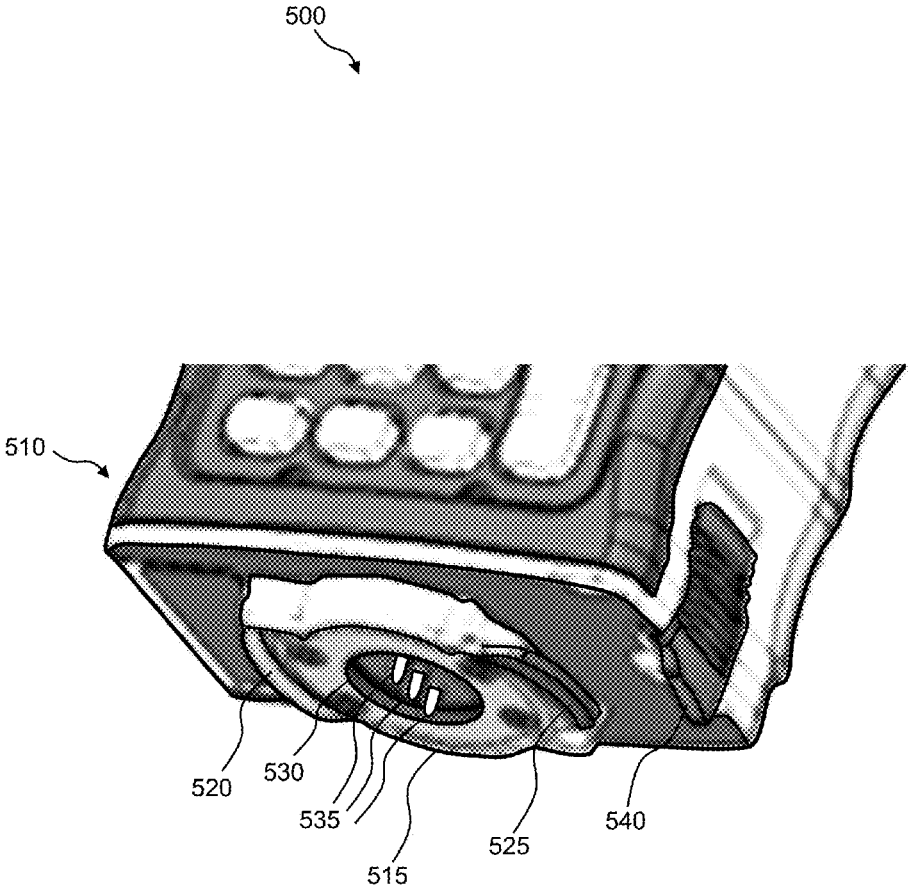
Figure 6:
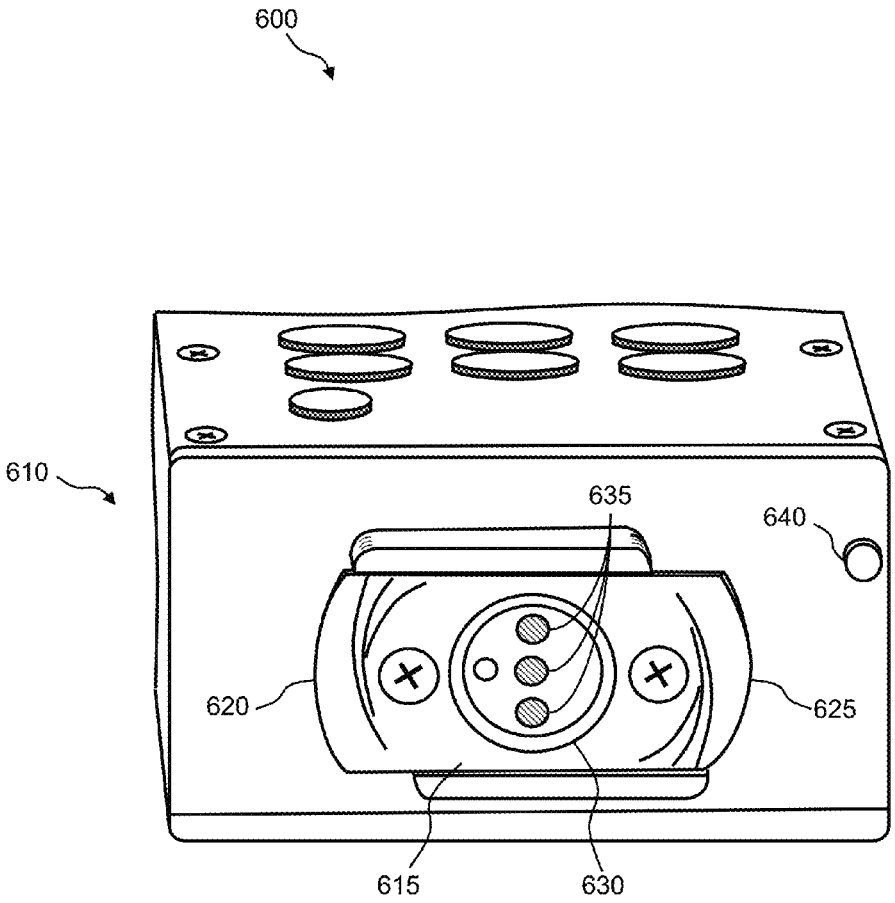
Figure 18:
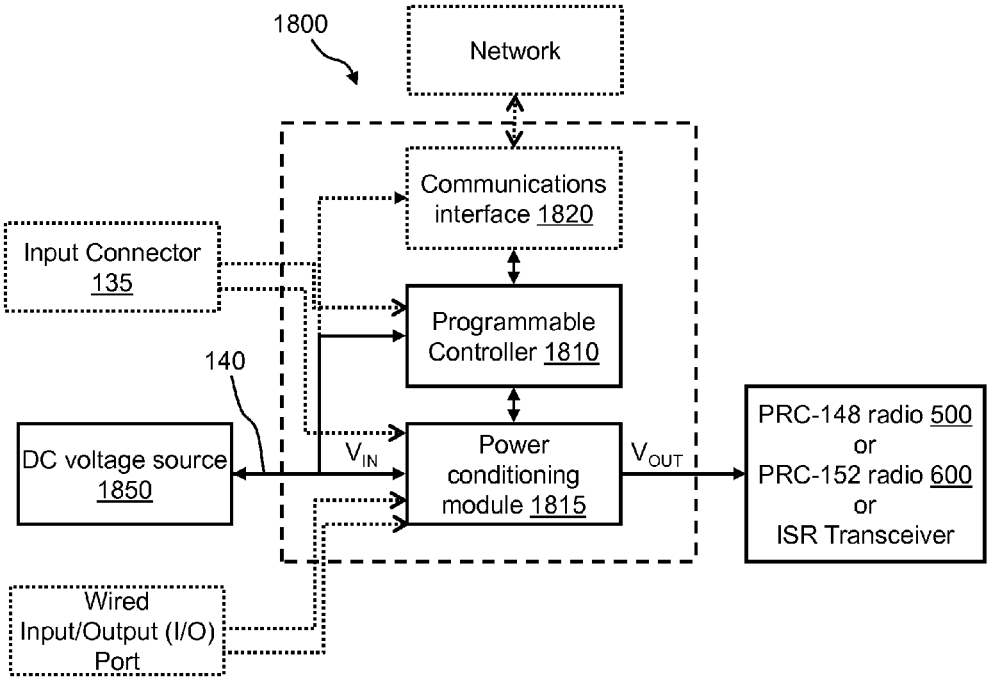
Figure 19:
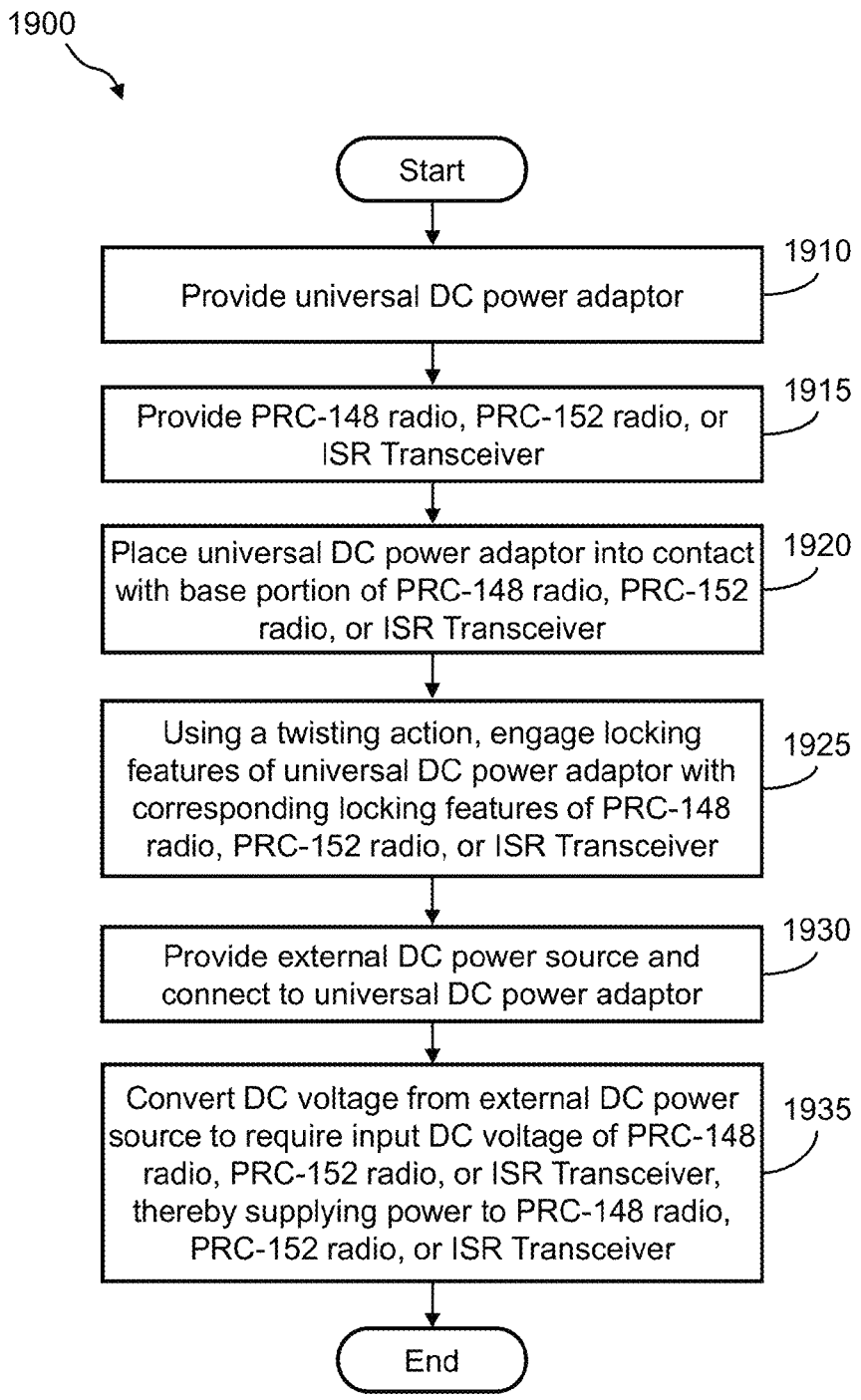

Having thus described the presently disclosed subject matter in general terms, reference will now be made to the accompanying Drawings, which are not necessarily drawn to scale, and wherein:

FIG. 1 illustrates a side view of an example of the presently disclosed universal DC power adaptor for the Handheld ISR Transceiver, PRC-148 radio, and PRC-152 radio;

FIG. 2 illustrates a side view of the presently disclosed universal DC power adaptor in a disassembled state;

FIG. 3 and FIG. 4 show perspective views of a portion of the adaptor plate assembly of the presently disclosed universal DC power adaptor;

FIG. 5 illustrates a perspective view of the base portion of the PRC-148 radio that mounts to the presently disclosed universal DC power adaptor;

FIG. 6 illustrates a perspective view of the base portion of the PRC-152 radio that mounts to the presently disclosed universal DC power adaptor;

FIG. 7 through FIG. 13 show various views of an example of the adaptor plate of the presently disclosed universal DC power adaptor, which show more details thereof;

FIG. 14 through FIG. 17 show various views of an example of the adaptor housing of the presently disclosed universal DC power adaptor, which show more details thereof;

FIG. 18 illustrates a block diagram of an example of the control electronics of the presently disclosed universal DC power adaptor; and FIG. 19 illustrates a flow diagram of an example of a method of using the presently disclosed universal DC power adaptor for the Handheld ISR Transceiver, PRC-148 radio, and PRC-152 radio.

DETAILED DESCRIPTION

The presently disclosed subject matter now will be described more fully hereinafter with reference to the accompanying Drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated Drawings. Therefore, it is to be understood that the presently disclosed subject matter is not to be limited to the specific embodiments disclosed and that modifications and other embodiments are intended to be included within the scope of the appended claims.

In some embodiments, the presently disclosed subject matter provides a universal DC power adaptor for a Handheld ISR Transceiver, a PRC-148 radio, and a PRC-152 radio and method of using same. The presently disclosed universal DC power adaptor allows the Handheld ISR Transceiver, the PRC-148 radio, and the PRC-152 radio to be connected to an external DC power source instead of using their respective batteries. Namely, the presently disclosed universal DC power adaptor includes mounting and locking features that are common to each of the Handheld ISR Transceiver, PRC-148 radio, and PRC-152 radio. Additionally, the universal DC power adaptor includes mounting and locking features that are unique to the Handheld ISR Transceiver, while at the same time including mounting and locking features that are unique to the PRC-148 radio, while also at the same time including mounting and locking features that are unique to the PRC-152 radio.

Further, the output voltage and power of the universal DC power adaptor is suitable for each of the Handheld ISR Transceiver, PRC-148 radio, and PRC-152 radio. The presently disclosed universal DC power adaptor is used to couple the Handheld ISR Transceiver, PRC-148 radio, or PRC-152 radio to an external DC power source in place of their respective batteries. Because the presently disclosed universal DC power adaptor can be used in common with each of the Handheld ISR Transceiver, PRC-148 radio, and PRC-152 radio, military personnel only need access to one type of adaptor only instead of to three types.

Accordingly, an aspect of the universal DC power adaptor is that it can (1) accommodate different mechanical key mechanisms of the respective PRC-148 and PRC-152 radios, and a Handheld ISR Transceiver, and (2) accommodate different operating voltages of the respective PRC-148 and PRC-152 radios, and a Handheld ISR Transceiver.

Another aspect of the universal DC power adaptor is that it includes control electronics that are programmable; namely, it can be programmed to receive different input voltages and still generate the required output voltage needed to satisfy the PRC-148 radio and the PRC-152 radio. Similarly, the Handheld ISR Transceiver is operable within the same voltages and, therefore, is further compatible with the DC power adaptor as described herein.

FIG. 1 and FIG. 2 illustrate side views of an example of the presently disclosed universal DC power adaptor 100 for both the PRC-148 radio and the PRC-152 radio. Namely, FIG. 1 shows the universal DC power adaptor 100 in an assembled state and FIG. 2 shows the universal DC power adaptor 100 in a disassembled state. The universal DC power adaptor 100 includes an adaptor plate assembly 110 mounted on an adaptor housing 115. The adaptor housing 115 is formed of any rigid, durable, lightweight material, such as, but not limited to, molded plastic or metal (e.g., aluminum, stainless steel, and the like). More details of the adaptor housing 115 are shown and described herein below with reference to FIG. 14 through FIG. 17.

The adaptor plate assembly 110 further includes an adaptor plate 120, a pair of locking plates 125 (e.g., locking plates 125*a* and 125*b*), a printed circuit board (PCB) 130 on which certain control electronics (see FIG. 18) are implemented, and an input connector 135 that is electrically coupled to the PCB 130. In some embodiments, a flexible wire or cable 140 can be used to electrically couple the input connector 135 to the PCB 130. The PCB 130 further includes a set of voltage output pins 145 (see FIG. 3 and FIG. 4).

The adaptor plate 120 is formed of any rigid, durable, lightweight material, such as, but not limited to, molded plastic or metal (e.g., aluminum). More details of the adaptor plate 120 are shown and described herein below with reference to FIG. 7 through FIG. 13. Likewise, the locking plates 125 can be formed of any rigid, durable, lightweight material, such as, but not limited to, molded plastic or metal (e.g., aluminum, stainless steel). The PCB 130 can be any standard multilayer printed circuit board. The input connector 135 can be any type of connecter. The input connector 135 is used to couple to an external DC power source, such as an external battery (not shown). Consequently, the type of connector 135 depends on the mating connector of the external DC power source. In one example, the universal DC power adaptor 100 has an overall length of about 2.6 inches, an overall width of about 1.5 inches, and an overall height of about 1.48 inches.

FIG. 3 and FIG. 4 show perspective views of a portion of the adaptor plate assembly 110 of the presently disclosed universal DC power adaptor 100. Namely, FIG. 3 and FIG. 4 show views of the adaptor plate 120 with the locking plates 125 affixed thereto. For example, each of the locking plates 125*a* and 125*b* is affixed to the adaptor plate 120 with a screw. The adaptor plate 120 also includes four through-holes 150 (e.g., one at each corner) that are used for screwing the adaptor plate 120 to the adaptor housing 115.

The locking plates 125*a* and 125*b* are arranged with respect to certain alignment features 155 and with respect to the voltage output pins 145. The alignment features 155 can be any type of features or rails for guiding the base portion of the PRC-148 radio (see FIG. 5) or the PRC-152 radio (see FIG. 6) onto the adaptor plate 120 of the universal DC power adaptor 100. Namely, the alignment features 155 are designed to substantially match corresponding features of the PRC-148 radio and the PRC-152 radio that allow the radios to twist and lock into the adaptor plate assembly 110.

The voltage output pins 145 are arranged at the center region of adaptor plate 120 and between the locking plates 125*a* and 125*b*. In particular, the voltage output pins 145 are arranged at about the pivot point of the PRC-148 radio (see FIG. 5) and the PRC-152 radio (see FIG. 6) when twisted and locked into the adaptor plate assembly 110. FIG. 3 and FIG. 4 show the voltage output pins 145 arranged in a pedestal structure 160 such that there is electrical isolation between, for example, the three voltage output pins 145. The position of the three voltage output pins 145 is provided to substantially align with corresponding voltage input pins of the PRC-148 radio (see FIG. 5) and the PRC-152 radio (see FIG. 6).

Referring now to FIG. 5, a perspective view of the base portion of the PRC-148 radio that mounts to the presently disclosed universal DC power adaptor 100 is provided. Namely, FIG. 5 shows a base portion 510 of a PRC-148 radio 500. The base portion 510 of the PRC-148 radio 500 includes a locking plate 515 that has a first end 520 and a second end 525. Further, there is an opening 530 at the center portion of the locking plate 515. A set of voltage input pins 535 (e.g., three voltage input pins 535) are arranged in the opening 530 of the locking plate 515, as shown. Additionally, a movable locking clip 540 is provided on one side of the body of the PRC-148 radio 500. Conventionally, the locking plate 515, the three voltage input pins 535, and the movable locking clip 540 are used for coupling a rechargeable battery (not shown) to the base portion 510 of the PRC-148 radio 500. The same locking plate 515, voltage input pins 535, and movable locking clip 540, however, can be used for coupling the presently disclosed universal DC power adaptor 100 to the base portion 510 of the PRC-148 radio 500 in place of the rechargeable battery.

Referring now to FIG. 6, a perspective view of the base portion of the PRC-152 radio that mounts to the presently disclosed universal DC power adaptor 100 is provided. Namely, FIG. 6 shows a base portion 610 of a PRC-152 radio 600. The base portion 610 of the PRC-152 radio 600 includes a locking plate 615 that has a first end 620 and a second end 625. Further, there is an opening 630 at the center portion of the locking plate 615. A set of voltage input pins 635 (e.g., three voltage input pins 635) are arranged in the opening 630 of the locking plate 615, as shown. Additionally, a spring-loaded button key 640 is provided on one the bottom surface of the body of the PRC-152 radio 600. Conventionally, the locking plate 615, the three voltage input pins 635, and the spring-loaded button key 640 are used for coupling a rechargeable battery (not shown) to the base portion 610 of the PRC-152 radio 600. The same locking plate 615, voltage input pins 635, and spring-loaded button key 640, however, can be used for coupling the presently disclosed universal DC power adaptor 100 to the base portion 610 of the PRC-152 radio 600 in place of the rechargeable battery.

Referring now to FIG. 5 and FIG. 6, certain features of the PRC-148 radio 500 and of the PRC-152 radio 600 are substantially the same. For example, the cross-sectional footprint and dimensions of the base portion 510 of the PRC-148 radio 500 are substantially the same as the cross-sectional footprint and dimensions of the base portion 610 of the PRC-152 radio 600. Further, the features of the locking plate 515 of the PRC-148 radio 500 are substantially the same as the features of the locking plate 615 of the PRC-152 radio 600. Further still, with respect to the locking plate 515 of the PRC-148 radio 500 and with respect to the locking plate 615 of the PRC-152 radio 600, the number and position of the voltage input pins 535 and the number and position the voltage input pins 635, respectively, are substantially the same.

Accordingly, and referring now again to FIG. 3 and FIG. 4, the cross-sectional footprint and dimensions of the universal DC power adaptor 100 substantially correspond to those of the PRC-148 radio 500 and the PRC-152 radio 600. Further, the locking plates 125*a* and 125*b* and the alignment features 155 of the universal DC power adaptor 100 are designed to receive and engage with the locking plate 515 of the PRC-148 radio 500 and the locking plate 615 of the PRC-152 radio 600. For example, the edges of the two locking plates 125 are designed to receive and engage with the first end 520 and the second end 525, respectively, of the locking plate 515 of the PRC-148 radio 500. Likewise, the edges of the two locking plates 125 are designed to receive and engage with the first end 620 and the second end 625, respectively, of the locking plate 615 of the PRC-152 radio 600. Once engaged, the voltage output pins 145 of the universal DC power adaptor 100 substantially align with and electrically couple to the voltage input pins 535 of the PRC-148 radio 500 or the voltage input pins 635 of the PRC-152 radio 600.

Additionally, certain other features of the PRC-148 radio 500 and the PRC-152 radio 600 are unique, i.e., not substantially the same. For example, the movable locking clip 540 on one side of the PRC-148 radio 500 is unique only to the PRC-148 radio 500. Further, the spring-loaded button key 640 on one the bottom surface of the body of the PRC-152 radio 600 is unique only to the PRC-152 radio 600.

Accordingly, the universal DC power adaptor 100 includes features for accommodating these unique features. For example and referring again to FIG. 3 and FIG. 4, the adaptor plate 120 further includes a pair of side locking features 165. Namely, a side locking feature 165*a* on one end of the adaptor plate 120 and a side locking feature 165*b* on the other end of the adaptor plate 120. The two side locking features 165 are designed to engage with the movable locking clip 540 of the PRC-148 radio 500. Two side locking features 165 are provided so that the PRC-148 radio 500 can be oriented in any way for coupling to the universal DC power adaptor 100. However, in another embodiment, the universal DC power adaptor 100 includes one side locking feature 165 only. In this case, the PRC-148 radio 500 would have to be oriented a certain way for coupling to the universal DC power adaptor 100.

Additionally, the adaptor plate 120 includes a pair of holes or detents 170. Namely, a hole or detent 170*a* on one end of the adaptor plate 120 and a hole or detent 170*b* on the other end of the adaptor plate 120. The two holes or detents 170 are designed to engage with the spring-loaded button key 640 of the PRC-152 radio 600. Two holes or detents 170 are provided so that the PRC-152 radio 600 can be oriented in any way for coupling to the universal DC power adaptor 100. However, in another embodiment, the universal DC power adaptor 100 includes one hole or detent 170 only. In this case, the PRC-152 radio 600 would have to be oriented a certain way for coupling to the universal DC power adaptor 100.

Figure 7:
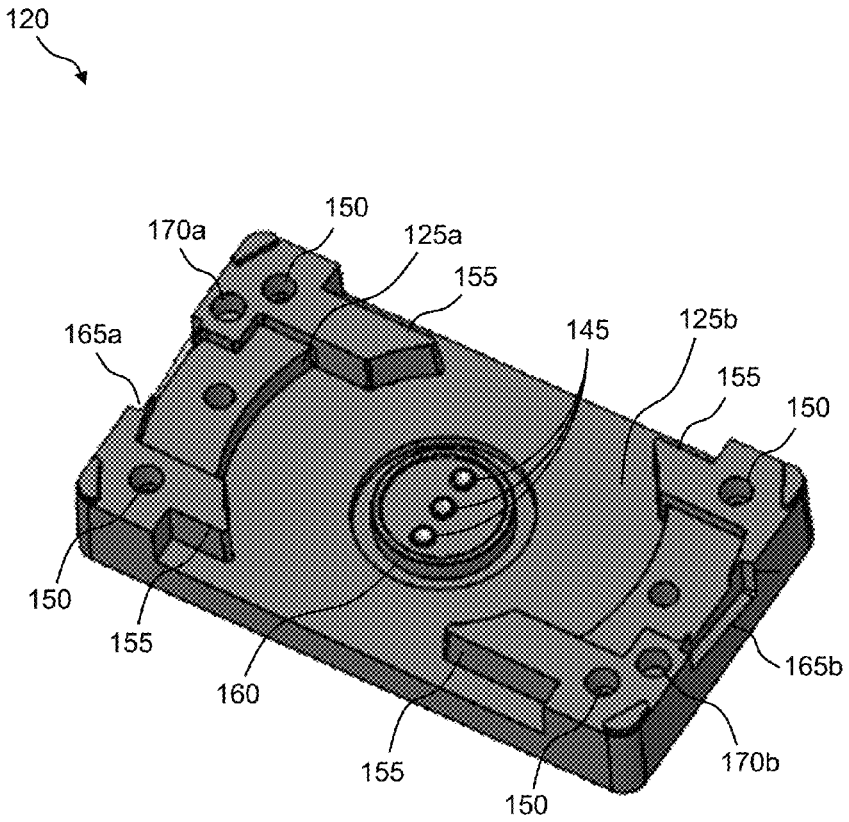
Figure 8:
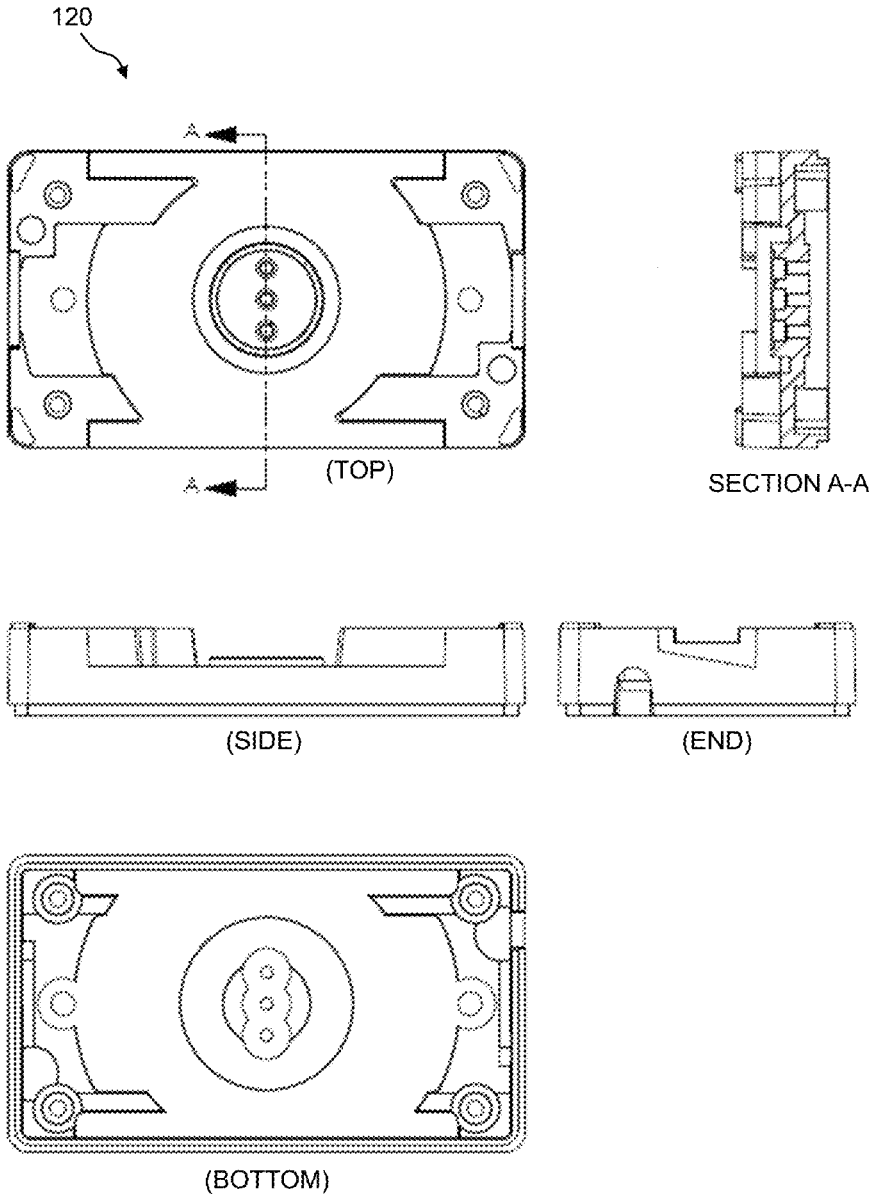
Figure 9:
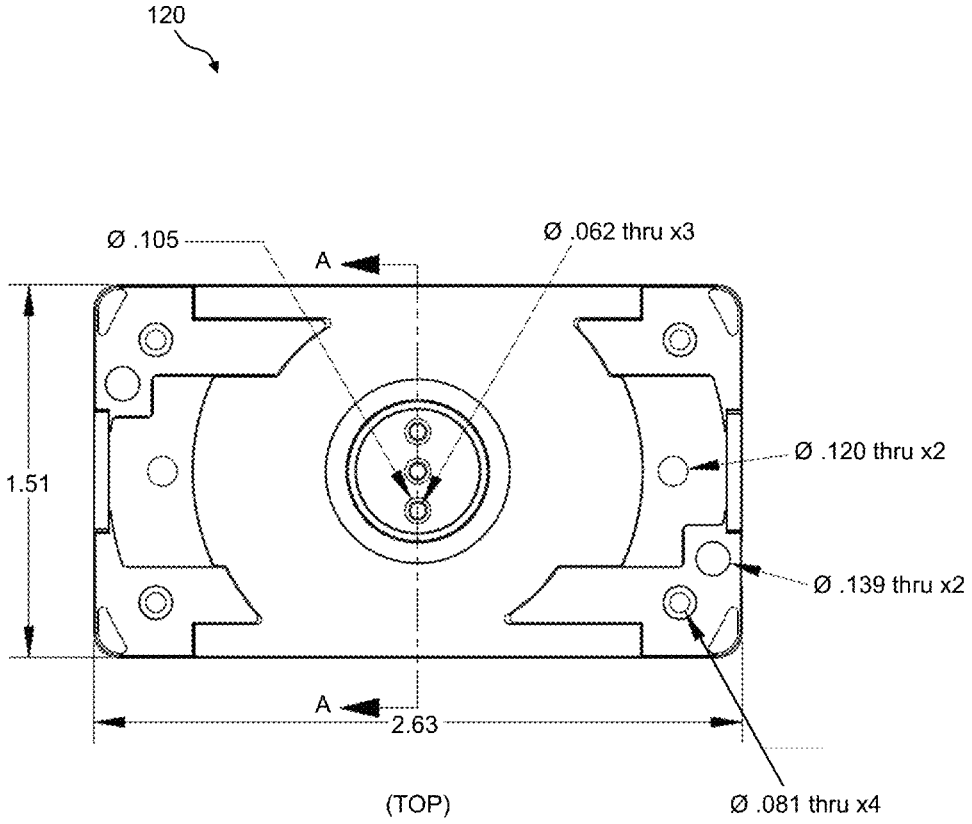
Figure 10:
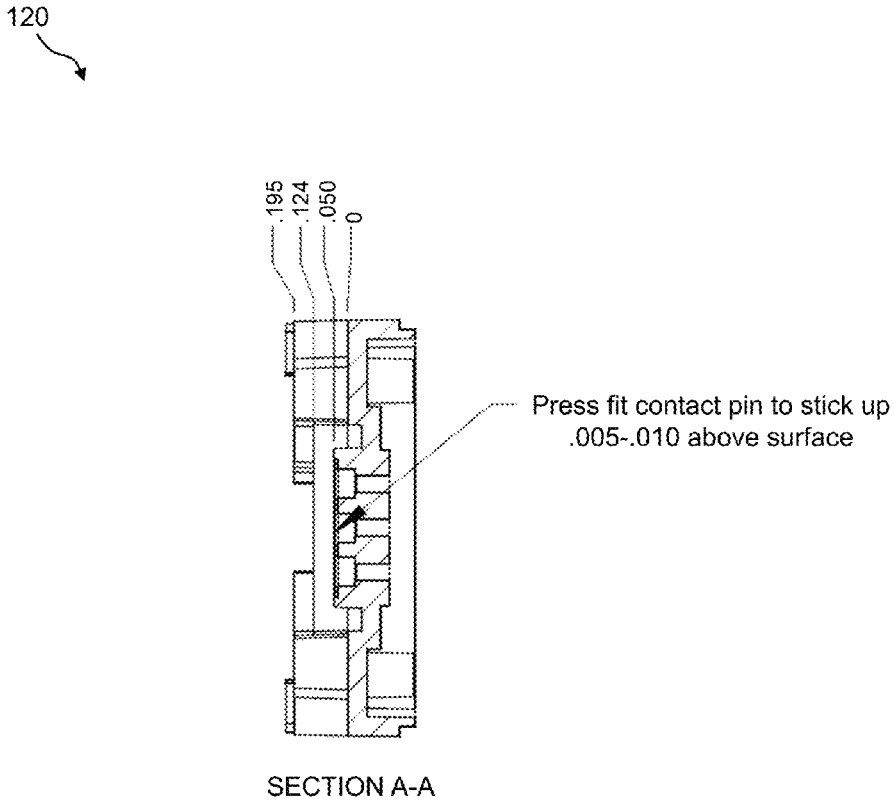
Figure 11:
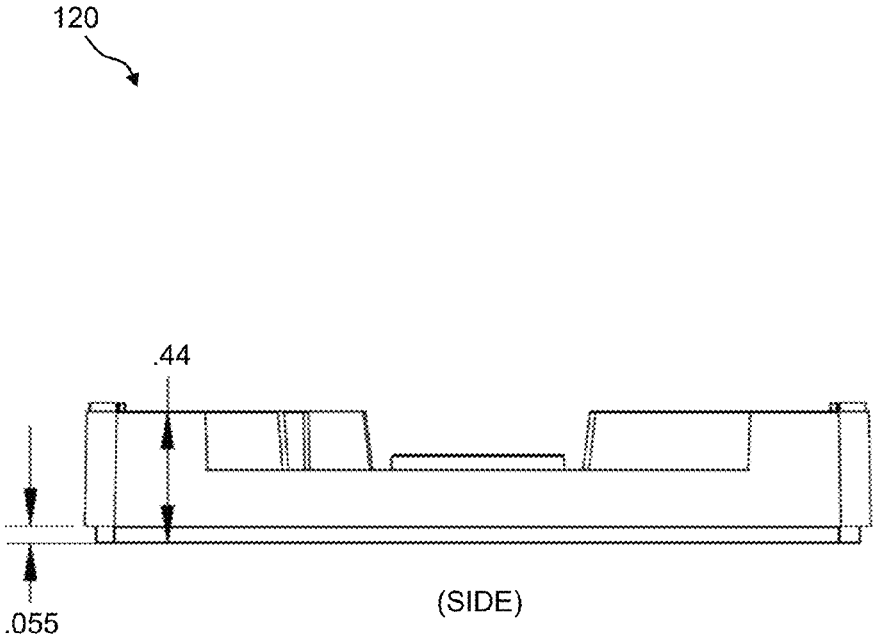
Figure 12:
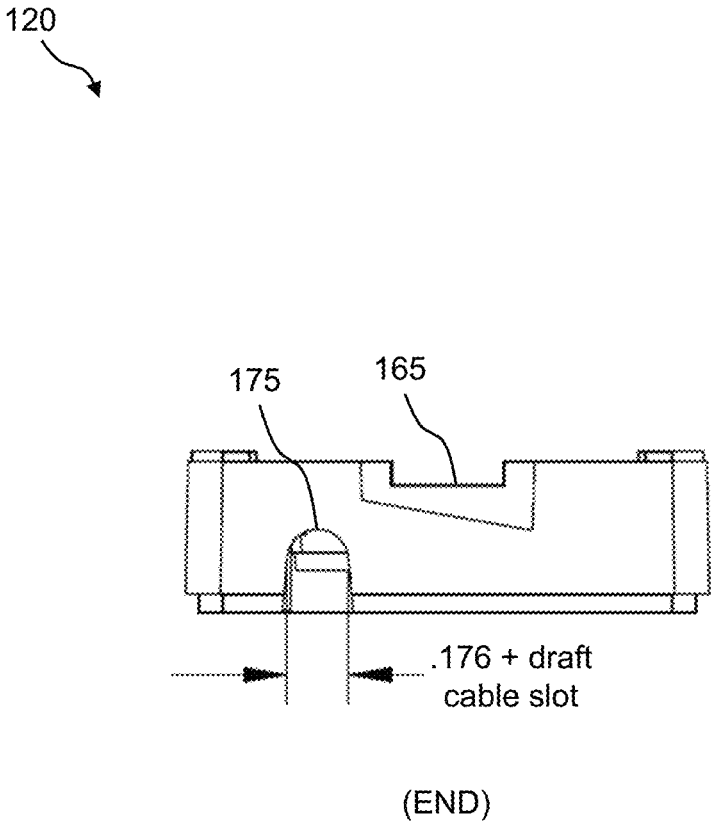
Figure 13:
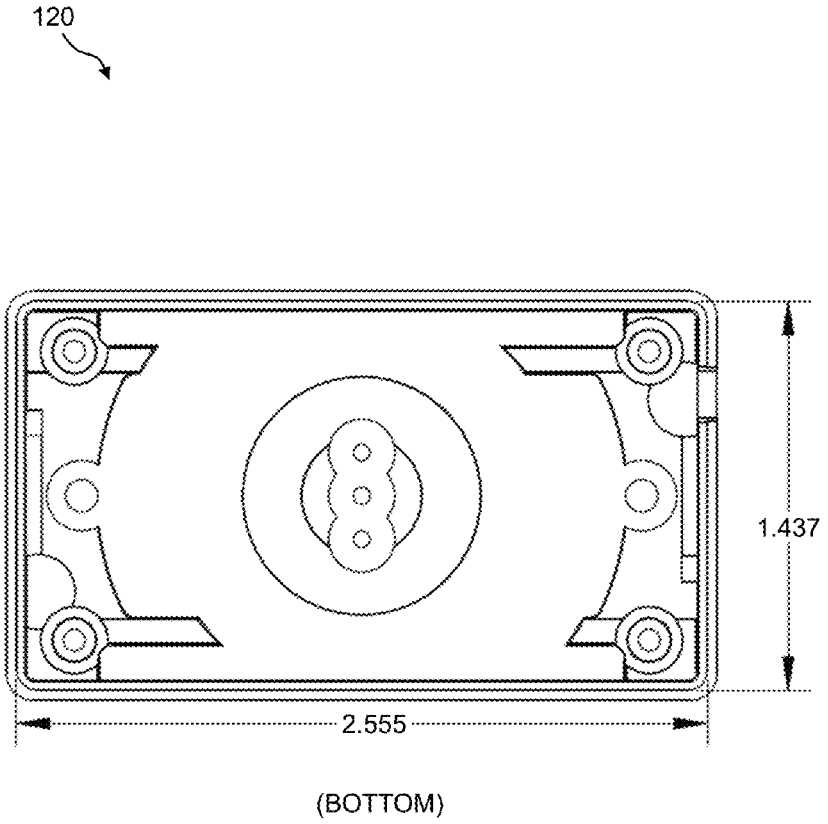

FIG. 7 through FIG. 13 illustrate various views of an example of the adaptor plate 120 of the presently disclosed universal DC power adaptor 100, which show more details thereof. In the example shown in FIG. 7 through FIG. 13, all dimensions are given in inches. FIG. 7 shows a perspective view of the adaptor plate 120. FIG. 8 shows a top view, a cross-sectional view taken along line A-A of the top view, a side view, an end view, and a bottom view of the adaptor plate 120, wherein the views are presented in relation to each other. FIG. 9 shows more details of the top view of the adaptor plate 120. FIG. 10 shows more details of the cross-sectional view of the adaptor plate 120, taken along line A-A of FIG. 9. FIG. 11 shows more details of the side view of the adaptor plate 120. FIG. 12 shows more details of the end view of the adaptor plate 120. FIG. 12 shows a cable slot 175, which is an opening through which the flexible wire or cable 140 (see FIG. 1 or FIG. 2) may feed. FIG. 13 shows more details of the bottom view of the adaptor plate 120.

Figure 14:
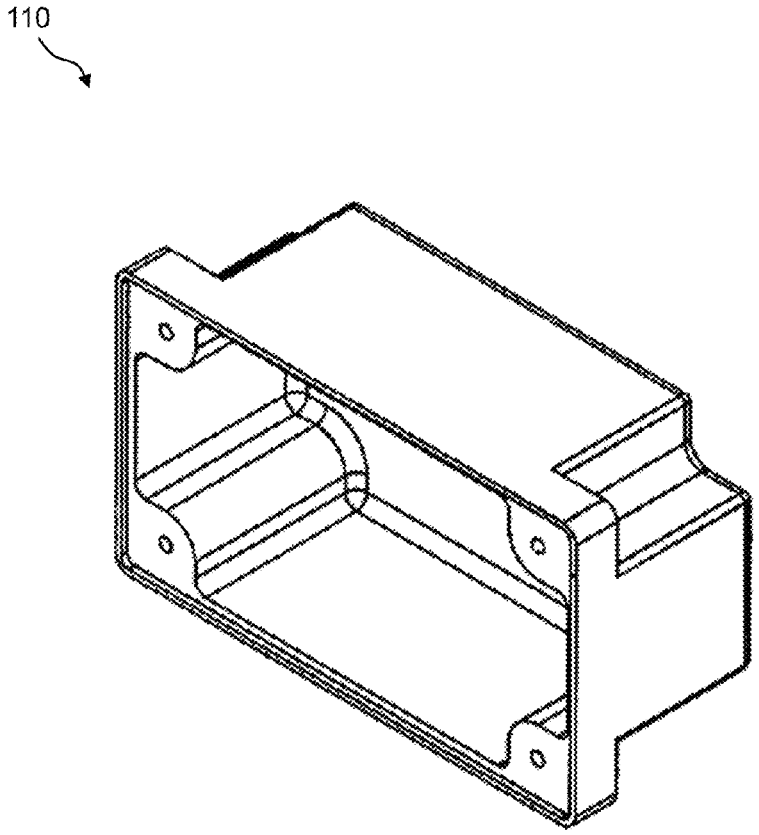
Figure 15:
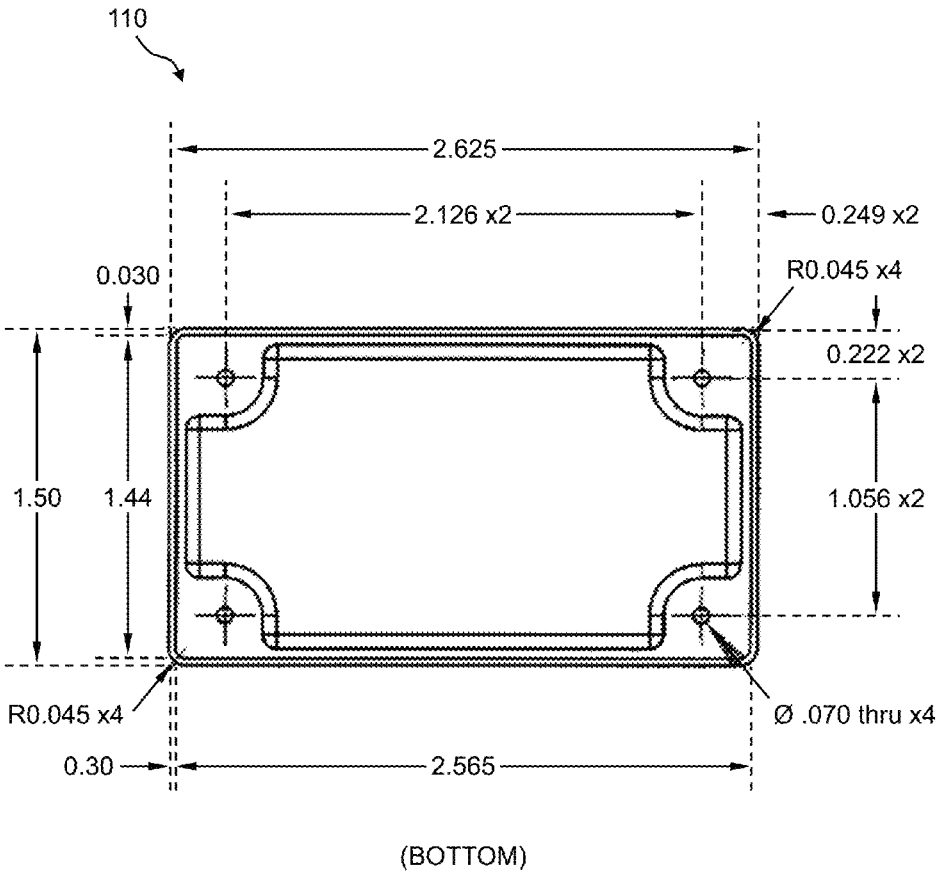
Figure 16:
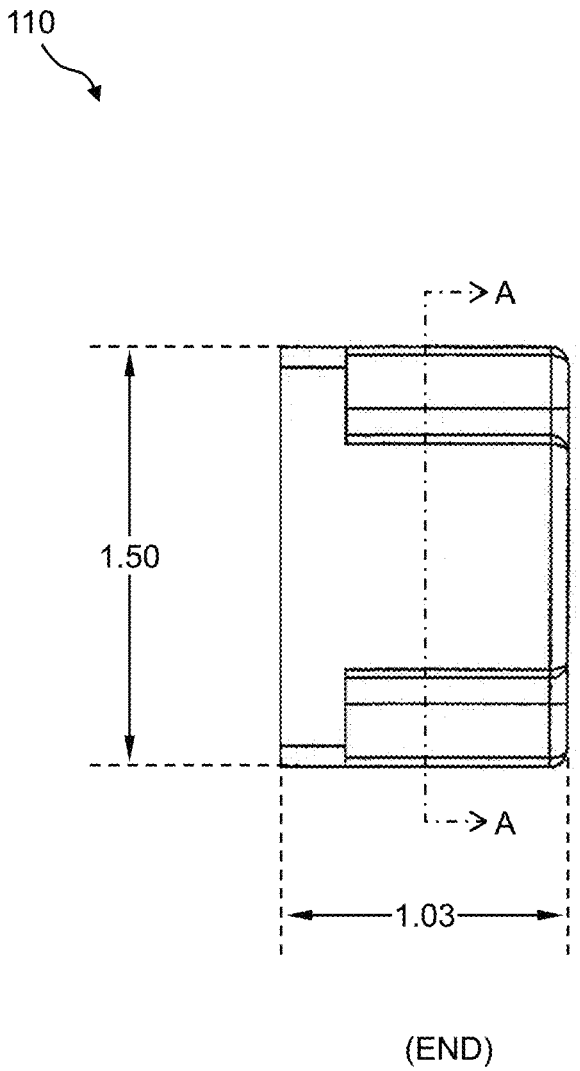
Figure 17:
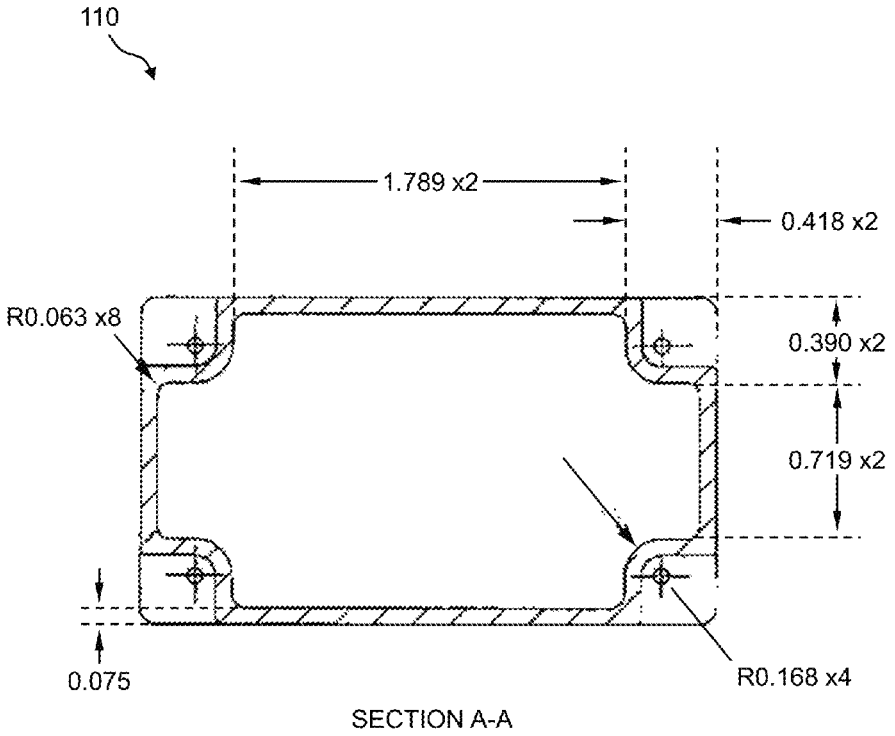

FIG. 14 through FIG. 17 illustrate various views of an example of the adaptor housing 115 of the presently disclosed universal DC power adaptor 100, which show more details thereof. In the example shown in FIG. 14 through FIG. 17, all dimensions are given in inches. FIG. 14 shows a perspective view of the adaptor housing 115. FIG. 15 shows a bottom view of the adaptor housing 115. FIG. 16 shows an end view of the adaptor housing 115. FIG. 17 shows a cross-sectional view of the adaptor housing 115, taken along line A-A of FIG. 16.

FIG. 18 illustrates a block diagram of an example of control electronics 1800 of the presently disclosed universal DC power adaptor 100. The control electronics 1800 can be implemented on the PCB 130 using standard PCB technology. The control electronics 1800 includes, for example, a controller 1810 and a power conditioning module 1815.

The controller 1810 can be any standard controller or microprocessor device that is capable of executing program instructions. The power conditioning module 1815 can be any power conditioning circuitry that receives a certain DC input voltage $V_{IN}$ within an expected input voltage range and generates a desired DC output voltage $V_{OUT}$.

The input of the power conditioning module 1815 (i.e., the DC input voltage $V_{IN}$) is driven by an external DC voltage source 1850. The external DC voltage source 1850 can be any DC voltage source, such as, but not limited to, a non-rechargeable battery, a rechargeable battery, and a DC power supply.

The DC output voltage $V_{OUT}$ of the power conditioning module 1815 drives either the PRC-148 radio 500 or the PRC-152 radio 600. The operating voltage of the PRC-148 radio 500 is from about 10 VDC to about 14.5 VDC, whereas the operating voltage of the PRC-152 radio 600 is from about 10 VDC to about 16.5 VDC. Given that the two operating voltage are slightly different, the DC output voltage $V_{OUT}$ of the universal DC power adaptor 100 is a value that is within the range of the overlapping portions of the two operating voltages. For example, the DC output voltage $V_{OUT}$ of the universal DC power adaptor 100 is limited to a range from about 10 VDC to about 14.5 VDC, which is the operating voltage range of the PRC-148 radio 500. In one example, the DC output voltage $V_{OUT}$ of the universal DC power adaptor 100 is about 11.8±0.5 VDC.

Further, the DC input voltage $V_{IN}$ of the universal DC power adaptor 100, which is supplied by the external DC voltage source 1850, can be, for example, from about 11.2 VDC±3% to about 17 VDC±3%. In this example, the power conditioning module 1815 converts the DC input voltage $V_{IN}$, which can range from about 11.2 VDC±3% to about 17 VDC±3%, to about 11.8±0.5 VDC. Because the DC input voltage $V_{IN}$ can vary, at certain times the power conditioning module 1815 is converting a lower input voltage to a higher output voltage, at others times the power conditioning module 1815 is converting a higher input voltage to a lower output voltage, and at yet others times the input voltage of the power conditioning module 1815 is substantially the same as the output voltage.

The controller 1810 and the power conditioning module 1815 of the control electronics 1800 are programmable. In the aforementioned example, the power conditioning module 1815 is programmed to receive from about 11.2 VDC±3% to about 17 VDC±3% and then generate about 11.8±0.5 VDC. However, the power conditioning module 1815 can be programmed to receive any DC input voltage $V_{IN}$ and still generate the required DC output voltage $V_{OUT}$. For example, the power conditioning module 1815 can be programmed to receive from about 25 VDC±3% to about 30 VDC±3% and then generate about 11.8±0.5 VDC. The programmability of the universal DC power adaptor 100 allows it to be used with different external DC voltage sources 1850.

In one example, the input connector 135 and the flexible wire or cable 140 can be used as a communication link to the controller 1810 and/or the power conditioning module 1815. In another example, a separate wired input/output (I/O) port (not shown) can be used as a communication link to the controller 1810 and/or the power conditioning module 1815. In yet another example, the control electronics 1800 includes a communications interface 1820. The communications interface 1820 may be any wired and/or wireless communication interface for connecting to a network (not shown) and by which information may be exchanged with other devices (not shown) connected to the network. Examples of wired communication interfaces may include, but are not limited to, USB ports, RS232 connectors, RJ45 connectors, Ethernet, and any combinations thereof. Examples of wireless communication interfaces may include, but are not limited to, an Intranet connection, Internet, ISM, Bluetooth® technology, Wi-Fi, Wi-Max, IEEE 802.11 technology, radio frequency (RF), Infrared Data Association (IrDA) compatible protocols, Local Area Networks (LAN), Wide Area Networks (WAN), Shared Wireless Access Protocol (SWAP), any combinations thereof, and other types of wireless networking protocols.

FIG. 19 illustrates a flow diagram of an example of a method 1900 of using the presently disclosed universal DC power adaptor 100 for either the PRC-148 radio or the PRC-152 radio. The method 1900 may include, but is not limited to, the following steps.

At a step 1910, the presently disclosed universal DC power adaptor 100 is provided. Namely, the universal DC power adaptor 100 that is described with reference to FIG. 1 through FIG. 18 is provided.

At a step 1915, the PRC-148 radio or the PRC-152 radio is provided without its standard rechargeable battery.

At a step 1920, the universal DC power adaptor 100 is placed into contact with the base portion of the PRC-148 radio or the PRC-152 radio.

At a step 1925, using a twisting action, the locking features of the universal DC power adaptor 100 engage with the corresponding locking features of the PRC-148 radio or the PRC-152 radio. In one example, using a twisting action, the first end 520 and the second end 525 of the locking plate 515 of the PRC-148 radio 500 are engaged with the respective edges of the two locking plates 125 of the universal DC power adaptor 100. Further, the movable locking clip 540 of the PRC-148 radio 500 is engaged with one of the two side locking features 165 of the universal DC power adaptor 100. In another example, using a twisting action, the first end 620 and the second end 625 of the locking plate 615 of the PRC-152 radio 600 are engaged with the respective edges of the two locking plates 125 of the universal DC power adaptor 100. Further, the spring-loaded button key 640 of the PRC-152 radio 600 is engaged with one of the two holes or detents 170 of the universal DC power adaptor 100. In so doing, the voltage output pins 145 of the universal DC power adaptor 100 are mechanically and electrically coupled to the voltage input pins 535 of the PRC-148 radio 500 or the voltage input pins 635 of the PRC-152 radio 600.

At a step 1930, an external DC power source, such as the external DC voltage source 1850 shown in FIG. 18, is provided and electrically coupled to the input of the universal DC power adaptor 100. For example, the input connector 135 of the universal DC power adaptor 100 is connected to a mating connector of the external DC voltage source 1850.

At a step 1935, the DC input voltage $V_{IN}$ is received at the input of the power conditioning module 1815 and then converted to the required DC output voltage $V_{OUT}$. In one example, the power conditioning module 1815 converts a DC input voltage $V_{IN}$ of from about 11.2 VDC±3% to about 17 VDC±3% to a DC output voltage $V_{OUT}$ of about 11.8±0.5 VDC. In so doing, power is supplied to the PRC-148 radio or the PRC-152 radio.

The universal DC power adaptor 100 can be disengaged from the PRC-148 radio 500 by disengaging the movable locking clip 540 of the PRC-148 radio 500 from the side locking feature 165 of the universal DC power adaptor 100 and then twisting the PRC-148 radio 500 with respect to the universal DC power adaptor 100 to disengage the locking plates. Similarly, the universal DC power adaptor 100 can be disengaged from the PRC-152 radio 600 by disengaging the spring-loaded button key 640 of the PRC-152 radio 600 from the hole or detent 170 of the universal DC power adaptor 100 and then twisting the PRC-152 radio 600 with respect to the universal DC power adaptor 100 to disengage the locking plates.

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, parameters, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments,±100% in some embodiments±50%, in some embodiments±20%, in some embodiments±10%, in some embodiments±5%, in some embodiments±1%, in some embodiments±0.5%, and in some embodiments±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

Although the foregoing subject matter has been described in some detail by way of illustration and example for purposes of clarity of understanding, it will be understood by those skilled in the art that certain changes and modifications can be practiced within the scope of the appended claims.

That which is claimed:

1. A universal DC power adaptor for coupling one of any of a Handheld ISR Transceiver, a PRC-148 radio, or a PRC-152 radio to a single external DC power source, comprising:

an adapter housing; and an adapter plate assembly mounted to the adapter housing, the adapter plate assembly further comprising an adapter plate comprising a top surface, a first end, and a second end;

a pair of locking plates;

at least one alignment feature comprising at least one side locking feature for engaging a locking clip of any of the Handheld ISR Transceiver, the PRC-148 radio, or the PRC-152 radio;

a printed circuit board; and an input connector electrically coupled to the printed circuit board;

wherein the printed circuit board further comprises control electronics and output voltage pins; and the pair of locking plates and alignment features are affixed to the top surface of the adaptor plate and configured to substantially align with corresponding features of the Handheld ISR Transceiver, the PRC-148 radio, and the PRC-152 radio such that the ISR Transceiver, or either radio, may twist and lock into the adaptor plate assembly, thereby mechanically coupling the transceiver or radio to the power adaptor and electrically coupling the transceiver or radio to the output voltage pins.

2. The universal DC power adaptor of claim 1, wherein the input connector is configured to couple to an external power source.

3. The universal DC power adaptor of claim 2, wherein the external power source comprises a non-rechargeable battery, a rechargeable battery, or a DC power supply.

4. The universal DC power adaptor of claim 1, wherein the input connector and printed circuit board are electrically coupled via a flexible cable.

5. The universal DC power adaptor of claim 4, wherein the adapter housing further comprises a cable slot configured to allow the flexible cable to pass from the printed circuit board through the adaptor housing to the input connector.

6. The universal DC power adaptor of claim 1, wherein the power adaptor has an overall length of about 2.6 inches, an overall width of about 1.5 inches, and an overall height of about 1.5 inches.

7. The universal DC power adaptor of claim 1, wherein the output voltage pins are disposed substantially in a center portion of the adaptor plate.

8. The universal DC power adaptor of claim 1, wherein the output voltage pins substantially align with input voltage pins of the Handheld ISR Transceiver, the PRC-148 radio, and the PRC-152 radio when the ISR Transceiver or either radio is mechanically coupled to the power adapter.

9. The universal DC power adaptor of claim 1, wherein the output voltage pins are electrically isolated from one another.

10. The universal DC power adaptor of claim 1, further comprising a side locking feature disposed on the first end of the adaptor plate and configured to receive a movable locking clip on the side of the PRC-148 radio.

11. The universal DC power adaptor of claim 1, further comprising a pair of side locking features each disposed on the first and second ends of the adaptor plate and each configured to selectively receive a movable locking clip on the side of the PRC-148 radio.

12. The universal DC power adaptor of claim 1, further comprising a hole or detent feature disposed on the first end of the adaptor plate and configured to engage with a spring-loaded button key on the PRC-152 radio.

13. The universal DC power adaptor of claim 1, further comprising a pair of holes or detents each disposed on the first and second ends of the power adaptor and configured to selectively engage with a spring-loaded button key on the PRC-152 radio.

14. The universal DC power adaptor of claim 1, wherein the adaptor housing is formed of molded plastic or metal.

15. The universal DC power adaptor of claim 1, wherein the adaptor plate is formed of molded plastic or metal.

16. The universal DC power adaptor of claim 1, wherein the locking plates are formed of molded plastic or metal.

17. The universal DC power adaptor of claim 1, wherein the alignment features are formed of molded plastic or metal.

18. The universal DC power adaptor of claim 1, wherein the control electronics further comprise a programmable controller and a power conditioning module.

19. The universal DC power adaptor of claim 18, wherein the power conditioning module is configured to receive an input voltage.

20. The universal DC power adaptor of claim 19, wherein the input voltage has a range from about 11.2 VDC±3% to about 17 VDC±3%.

21. The universal DC power adaptor of claim 19, wherein the input voltage has a range from about 25 VDC±3% to about 30 VDC±3%.

22. The universal DC power adaptor of claim 18, wherein the power conditioning module is configured to output a voltage within a range acceptable to any one of the ISR Transceiver, the PRC-148 radio, or the PRC-152 radio.

23. The universal DC power adaptor of claim 18, wherein the power conditioning module is configured to output a voltage within a range of about 10 VDC to about 14.5 VDC.

24. The universal DC power adaptor of claim 23, wherein the power conditioning module is configured to output a voltage of about 11.8±0.5 VDC.

25. The universal DC power adaptor of claim 18, further comprising a wired input/output port configured to facilitate external communication with the controller and/or power conditioning module.

26. The universal DC power adaptor of claim 25, wherein the wired input/output port is the input connector.

27. The universal DC power adaptor of claim 1, wherein the control electronics further comprise a communications interface configured to facilitate communication between the control electronics and a network.

28. The universal DC power adaptor of claim 27, wherein the communications interface is coupled to the network through a wired interface.

29. The universal DC power adaptor of claim 28, wherein the wired interface is selected from one or more of a group consisting of a USB port, an RS232 connector, an RJ45 connector, or Ethernet.

30. The universal DC power adaptor of claim 27, wherein the communications interface is coupled to the network through a wireless interface.

31. The universal DC power adaptor of claim 30, wherein the wireless interface is selected from one or more of a group consisting of an Intranet connection, Internet, ISM, Bluetooth technology, Wi-Fi, Wi-Max, IEEE 802.11 technology, radio frequency (RF), Infrared Data Association compatible protocols, Local Area Networks, Wide Area Networks, or Shared Wireless Access Protocol.

* * * * *